US008172649B2

(12) United States Patent
Mann, Jr. et al.

(10) Patent No.: US 8,172,649 B2
(45) Date of Patent: May 8, 2012

(54) FLOOR EDGER AND GRINDER DEVICE

(75) Inventors: Thomas E. Mann, Jr., Walden, NY (US); Jaime R. Castaner Weiss, Wappingers Falls, NY (US)

(73) Assignee: Onfloor Technologies, L.L.C., Newburgh, NY (US)

( * ) Notice: Subject to any disclaimer, the term of this patent is extended or adjusted under 35 U.S.C. 154(b) by 573 days.

(21) Appl. No.: 12/361,106

(22) Filed: Jan. 28, 2009

(65) Prior Publication Data

US 2010/0190422 A1 Jul. 29, 2010

(51) Int. Cl.
*B24B 27/08* (2006.01)

(52) U.S. Cl. ..... 451/353; 451/350; 451/359; 451/262

(58) Field of Classification Search ..... 451/350, 451/353, 359, 262, 451–459; 15/49.1; 16/437; 280/43, 43.17, 43.24
See application file for complete search history.

(56) References Cited

U.S. PATENT DOCUMENTS

| | | | | |
|---|---|---|---|---|
| 1,591,997 | A * | 7/1926 | Pond | 451/353 |
| 1,928,390 | A * | 9/1933 | Myers | 451/353 |
| 2,673,996 | A | 4/1954 | Gerber | |
| 2,754,630 | A * | 7/1956 | Jones | 451/146 |
| 2,759,305 | A * | 8/1956 | Helbig | 451/356 |
| 2,978,719 | A | 4/1961 | Arones | |
| 3,011,191 | A * | 12/1961 | Hulsh | 15/49.1 |
| 3,098,329 | A * | 7/1963 | Doran | 451/353 |
| 3,398,490 | A | 8/1968 | Redifer | |
| 3,496,681 | A | 2/1970 | Oswald | |
| 3,721,048 | A * | 3/1973 | Rand | 451/350 |
| 4,010,507 | A | 3/1977 | Johnson | |
| 4,136,491 | A | 1/1979 | Redifer | |
| 4,155,596 | A | 5/1979 | Brejcha | |
| 4,244,427 | A * | 1/1981 | Enters et al. | 172/42 |
| 4,709,510 | A | 12/1987 | Giovanni et al. | |
| 4,775,306 | A | 10/1988 | Kikuchi et al. | |
| 4,845,798 | A * | 7/1989 | Genovese | 15/98 |
| 5,507,061 | A | 4/1996 | Miyazaki | |
| 5,765,250 | A * | 6/1998 | Lee | 15/49.1 |
| 5,788,561 | A | 8/1998 | Pearlman et al. | |
| 5,890,954 | A | 4/1999 | Barous | |
| 6,003,570 | A * | 12/1999 | Falatok et al. | 144/24.12 |
| 6,238,277 | B1 * | 5/2001 | Duncan et al. | 451/271 |

(Continued)

FOREIGN PATENT DOCUMENTS

DE 42 19 093 A1 8/1993

OTHER PUBLICATIONS

HTC 130 Technical Data Sheets, HTC Product Catalog 2008, Copyright 2006, 2 sheets.

(Continued)

*Primary Examiner* — George Nguyen
(74) *Attorney, Agent, or Firm* — Reising Ethington P.C.

(57) ABSTRACT

A floor edger and grinding device 10 has a deck 20 pivotably mounted to a rear frame 18 with a handle 16. The deck has a motor 22 mounted thereon that drives two grinder discs 24 in opposite rotational directions. The deck has a skirt 26 and a notch 28 extending along the front edge 27 of the skirt. The discs 24 protrude into the notch 28. A case 50 surrounds the drive gears 38 for protection against dust created by the discs 24.

14 Claims, 4 Drawing Sheets

U.S. PATENT DOCUMENTS

| | | | | |
|---|---|---|---|---|
| 6,494,772 | B1 * | 12/2002 | Barnes et al. | 451/353 |
| 6,494,773 | B1 * | 12/2002 | Marchini et al. | 451/353 |
| 6,578,858 | B1 * | 6/2003 | Haddock | 280/47.131 |
| 6,616,517 | B2 | 9/2003 | Palushi | |
| 6,699,114 | B1 * | 3/2004 | Booeshaghi et al. | 451/451 |
| 6,739,963 | B1 * | 5/2004 | Mas Garcia | 451/541 |
| 6,871,371 | B2 | 3/2005 | Guest | |
| 7,140,957 | B2 | 11/2006 | Thysell et al. | |
| 7,247,085 | B1 * | 7/2007 | Anderson | 451/350 |
| 7,261,623 | B1 | 8/2007 | Palushi | |
| 7,399,140 | B2 * | 7/2008 | Barcenas | 404/112 |
| 7,686,677 | B2 * | 3/2010 | Peterson | 451/353 |
| 2008/0171499 | A1 | 7/2008 | Stoll | |

OTHER PUBLICATIONS

EDCO Edge Grinder Photograph, 1 sheet, Printed from website Nov. 21, 2008.

HUM-B Edge Grinder Advertising, 2 sheets.

* cited by examiner

FLOOR EDGER AND GRINDER DEVICE

TECHNICAL FIELD

The field of this invention relates floor grinders and more particularly to floor edge grinders.

BACKGROUND OF THE DISCLOSURE

Concrete floors are common today in large, medium and small retail stores, manufacturing and production facilities, warehouses, automotive shops and service centers, shopping centers, sidewalks, garages, commercial buildings and residential basements. The strength of concrete provides the durability and rigidity required in these environments. However, the exterior surface of a newly poured concrete floor, once dry, is often rough, uneven, and provides a dull appearance. Furthermore, when left in this unfinished state, the concrete will inherently produce dust particles from the constant scuffing, whether it is from foot traffic or wheeled traffic that can build over time and become a nuisance to those who work and/or live in these environments. It is well known to first grind the concrete surface and then coat the surface with a sealant to smooth the concrete, to make it aesthetically pleasing to the eye, and to help reduce dust particles.

In the grinding process, commonly used grinding machines usually have a planetary or direct drive belt and gear drive systems containing a plurality of circular drive plates mounted to gears on a deck with removable abrasive pads attached to each drive plate. These grinding machines may also be referred to as grinding, honing, abrasive or abrading machines. They may also be referred to as polishing and cleaning machines. Hereinafter, the term "grinder" is used in the generic sense and includes abrasion, scrubbing, sweeping, honing, grinding, sanding and/or abrading, cleaning and polishing. These types of machines can also be referred to as an apparatus for treating a floor surface. The term "treating a floor surface" as used herein can mean either cleaning, abrading, sanding, scrubbing, grinding, polishing, or honing a floor surface. These polishing and cleaning machines may typically be electric walk along machines where an operator stands behind the machine and pushes it along at a certain pace such that the deck sufficiently grinds, abrades, hones, polishes and or cleans the floor surface.

While walk along configurations and ride-on configurations have both been used, they both generally cannot be used to grind or sand close to an edge of the floor surface where a wall, molding or shelf stands extend vertically upward. As a result, smaller edge grinders have been developed to treat the floor surface next to any vertical wall or unit. These units are generally smaller than a fall grinder or polisher and may have a single grinder disc where the disc protrudes out of a housing or deck. Presently known constructions for edge grinders pose several problems. Firstly, the rotation of the single disc produces a torque on the entire machine which produces fatigue in the operator and makes it harder for the operator to control the machines. More aggressive treatments of floors such as abrading and sanding exert signified torque which can quickly fatigue an operator who is working hard to control the machine. In addition, the exposed edge of the disc may engage and gouge the wall or side molding if the operator does not adequately control the machine.

What is needed is a floor edge grinder that reduces or eliminates the torque on the operator and provides a safeguard to prevent the disc from gouging any wall or side molding.

SUMMARY OF THE DISCLOSURE

In accordance with one aspect of the invention, a floor edger and grinder device for treating a floor surface has a frame assembly with floor engaging wheels. A rear handle operably connects to the frame. A deck with an edge grinder disc and a drive motor operably mounted thereto.

The deck has a pivotable connection about a vertical axis to a selected fixed position to a front section of the frame assembly. The pivotable connection has an inner ring connected to one of the frame assembly and the deck and an outer ling securely connected to the other of the frame assembly and the deck. The inner and outer rings are pivotably engaged to each other.

A securing pin is horizontally disposed and mounted on one of the deck and the frame and is selectively engagable to one of the rings mounted on the other the deck and fame through one of a plurality of apertures therethrough. The securing pin is horizontally movable to disengage from the inner ring to allow the deck to rotate with respect to the frame.

Preferably, one of the inner and outer rings mounts the motor thereon. The motor is operably connected to at least one grinder disc mounted on the underside of the deck.

In one embodiment, the at least one grinder disc includes a first and second grinder disc. The motor is operably connected to a first drive pulley. A first belt connects the first pulley to a first pulley wheel for rotating the first grinder disc in a first direction. The first drive pulley is operably engaged to a second drive pulley. A second belt connects the second drive pulley to a second pulley wheel for rotating the second grinder disc in an opposite direction from the first direction of rotation of the first grinder disc.

In one embodiment, the first and second grinder discs are positioned in a side by side lateral relationship relative to a front edge of the deck. The front edge of the deck has a downwardly depending front skirt. The front skirt has a notch extending across a major portion thereof. The first and second grinder discs protrude partially into the notch. A vacuum port passes through a front section of the deck laterally between the first and second grinder discs.

In accordance with another aspect of the invention, a floor edger and grinder device has a deck; a motor mounted to the deck and has a downwardly extending drive shaft. First and second pulleys are laterally spaced from each other and are rotatably connected to the deck with an axis of rotation of each pulley being parallel to an axis of rotation of the drive shaft. Each pulley is constructed to have grinder discs mountable thereon. A first drive pulley is directly mounted on the drive shaft such that the rotational axis of the first drive pulley coincides with the rotational axis of the drive shaft. A first belt engages the first drive pulley and first pulley for rotating the first pulley in a first rotational direction. A second drive pulley is rotatably mounted to the housing with its axis of rotation parallel to the rotational axis of the drive shaft. The first drive pulley is engagable to the second drive pulley to drivingly rotate the second drive pulley. A second belt engages the second drive pulley and the second pulley for drivingly rotating the second pulley in a second rotatable direction opposite of the first rotational direction. Preferably, the motor is secured to a ring mounted on the deck. The ring is adjustably affixed about a pivot axis aligned with the rotational axis of the drive shaft to a frame assembly.

In one embodiment, the ring has a plurality of circumferentially spaced apertures engagable to a lock pin on the frame for affixing the ring and the deck in a selected rotated position relative to the frame.

In accordance with another aspect of the invention, a floor edger and grinder device has a deck and a motor mounted atop of the deck with a drive shaft extending down underneath the deck. Two grinder discs are rotatably mounted to an underside of the deck and are laterally positioned relative to each other and operably connected to the drive shaft. The deck has a downwardly depending skirt guard. The deck has a straight front section and notch in the front section of the skirt. The notch has a width extending laterally beyond a point directly in front of each rotational axis of the respective grinder discs. Each grinder disc has a section protruding into the notch.

Preferably, each of the grinder discs is operably mounted to the drive shaft for rotation in opposite directions with respect to each other grinder disc. The motor and housing are pivotably mounted to a frame assembly with floor engaging wheels and a rear handle.

In one embodiment, the floor engaging wheel includes a first set of castors and a second set of fixed wheels mounted on a sub-assembly that is reversibly mounted on the frame assembly. The handle is selectively mounted to the frame assembly in either an operable position or a storage position.

BRIEF DESCRIPTION OF THE DRAWINGS

Reference flow is made to the accompanying drawings in which.

DETAILED DESCRIPTION OF THE PREFERRED EMBODIMENT

Figure 1:
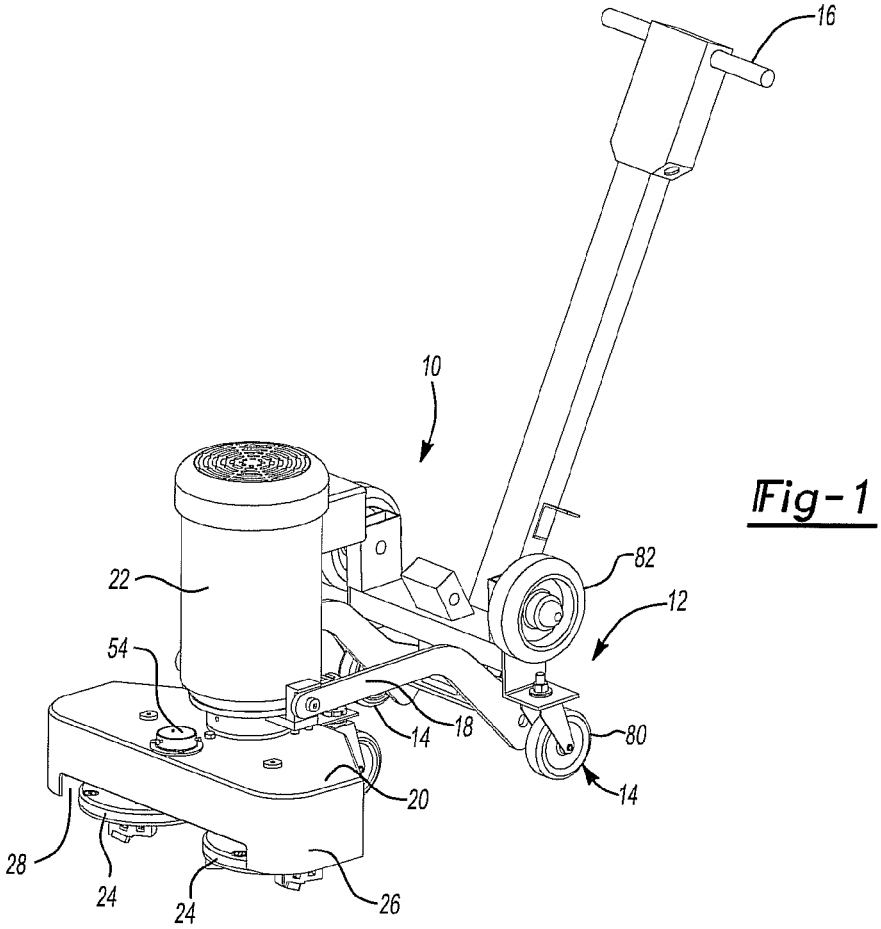
FIG. 1 is a front perspective view of a floor edger and grinder device in accordance with one embodiment of the invention.

Referring now to FIG. 1, a floor edger device 10 has a frame 12 with wheels 14 and a rear handle 16. The frame 12 is connected at its front end 18 to a deck 20. The deck 20 has a motor 22 mounted at it top side and two rotatable and laterally spaced grinder discs 24 at its underside. The deck 20 has a peripheral depending skirt 26. The front edge 27 of the skirt 26 has a notch or window 28 that substantially extends across the front edge 27.

Figure 2:
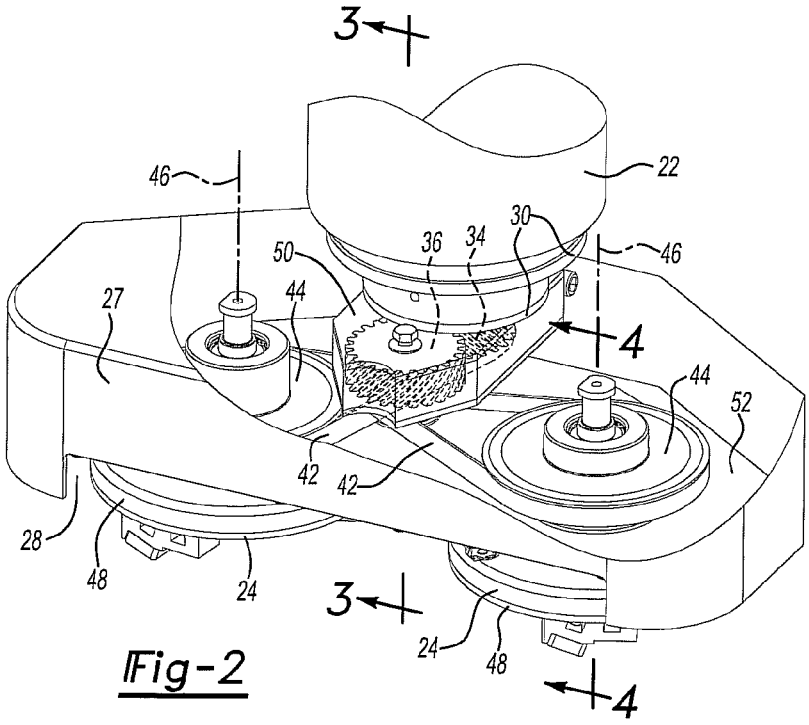
FIG. 2 is fragmentary and partially segmented view of the housing shown in FIG. 1 illustrating the drive mechanism from the motor to the grinder discs.
Figure 3:
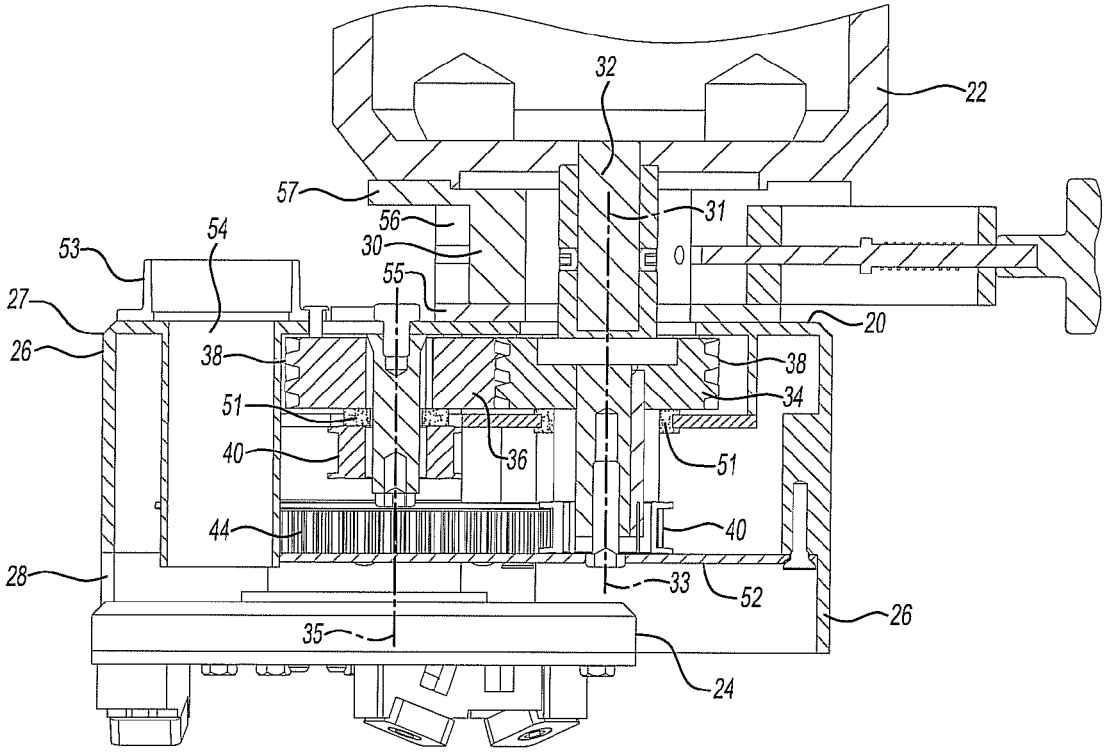
FIG. 3 is an enlarged cross-sectional fragmentary view taken along lines 3-3 in FIG. 2 with the belts removed.
Figure 4:
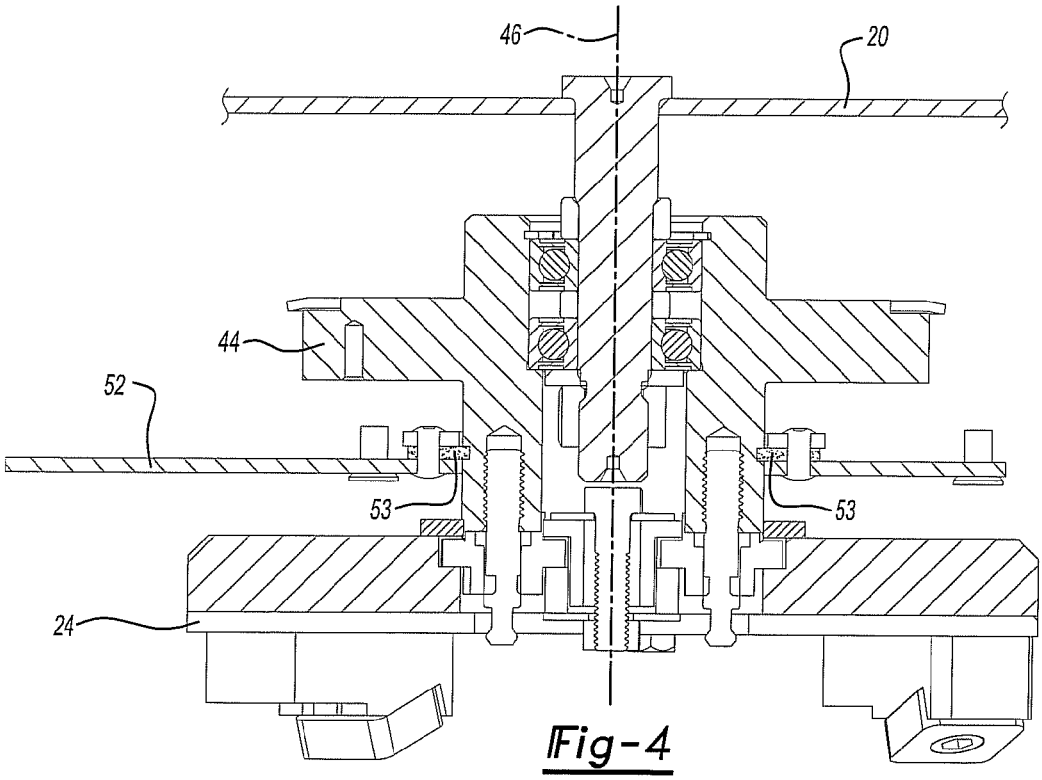
FIG. 4 is an enlarged cross-sectional fragmentary view taken along lines 4-4 in FIG. 3 with the belt removed.

As more clearly shown in FIGS. 2, 3 and 4, the motor 22 is mounted on an inner ring 30 secured on the deck. The motor has a drive shaft 32 that extends down below the deck 20. A first combination pulley and gear wheel 34 is rotatably mounted on the deck with its axis of rotation 33 coinciding with the axial rotation 31 of drive shaft 32. A second combination pulley and gear wheel 36 is rotatably mounted to the deck with its axis of rotation 35 parallel to axis 31 with the complementary gear sections 38 of each wheel 34 and 36 engaged such that each combination pulley and gear wheel 34 and 36 will rotate in opposite directions. The drive pulley section 40 of each combination pulley and gear wheel 34 and 36 engage a respective belt 42 that engage a respective pulley 44 mounted above the grinder discs 24 such that the respective two grinder discs 24 rotate in opposite directions. The grinder discs 24 are conventionally mounted to the pulleys 44.

Figure 5:
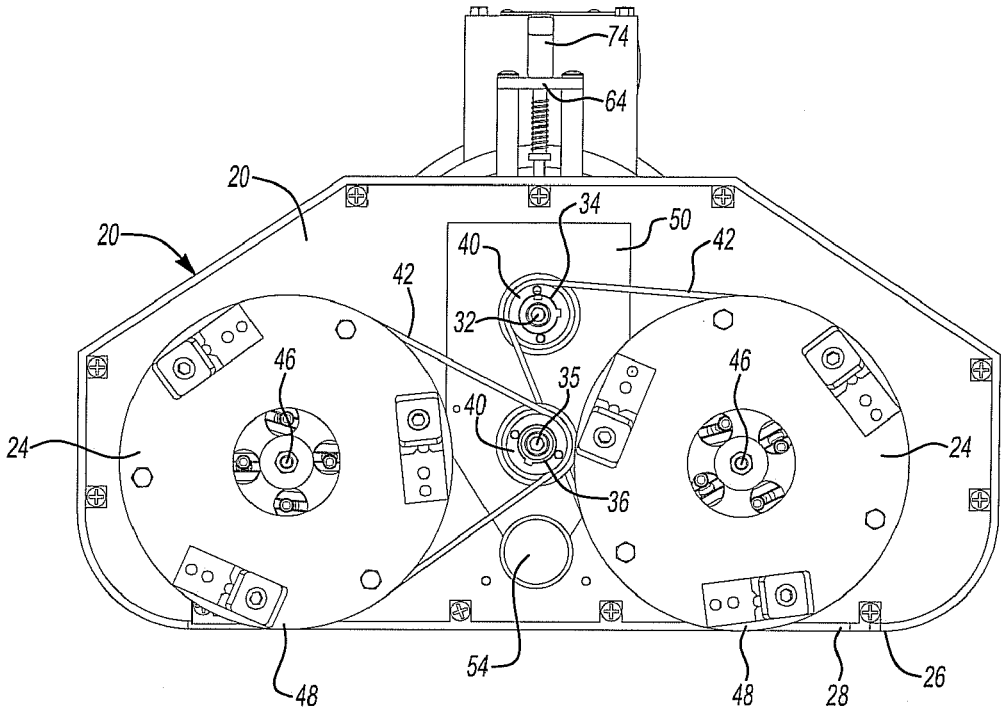
FIG. 5 is a bottom plan view illustrating the arrangement of the grinder discs relative to the notch in the housing skirt.

A shown more clearly in FIG. 5, the notch 28 in skirt 26 extends laterally a sufficient distance to be directly in front of each axis of rotation 46 of the respective laterally spaced grinder discs 24 such that the front peripheral section 48 of each disc intrudes into the notch but does not extend in front of the skirt 26. In this manner, the grinder discs can approach a floor edge but the skirt 26 provides a protective guard against the grinder discs from hitting or marring a vertical wall at the edge of the floor.

A protective casing 50 surrounds the gear sections 38 of each combination pulley and gear wheel 34 and 36. Felt seals 51 close the gap between the casing 50 and the rotating combination pulley and gear wheels 34 and 36. In this fashion, the felt seals 51 protect the gears 38 from dust created by the grinder discs 24. The casing 50 also greatly prolongs the effective life of any lubrication applied to the gears 38.

A protective plate 52 is mounted to the deck underside and under casing 50 to cover the belts 42 and the pulley sections 40 and protect them from the dust created by the grinder discs. Felt seals 52 fill the gap between plate 52 and rotating pulley 44 and disc 24 to further prevent dust from accumulating at the pulleys 44 and belts 42.

A vacuum port 54 is mounted through the front section of the deck 20 near a center line of the deck and extends down through the protective plate 52. A top nozzle connection 53 allows a vacuum tube to be connected thereto which is conventionally connected to a vacuum source.

Figure 6:
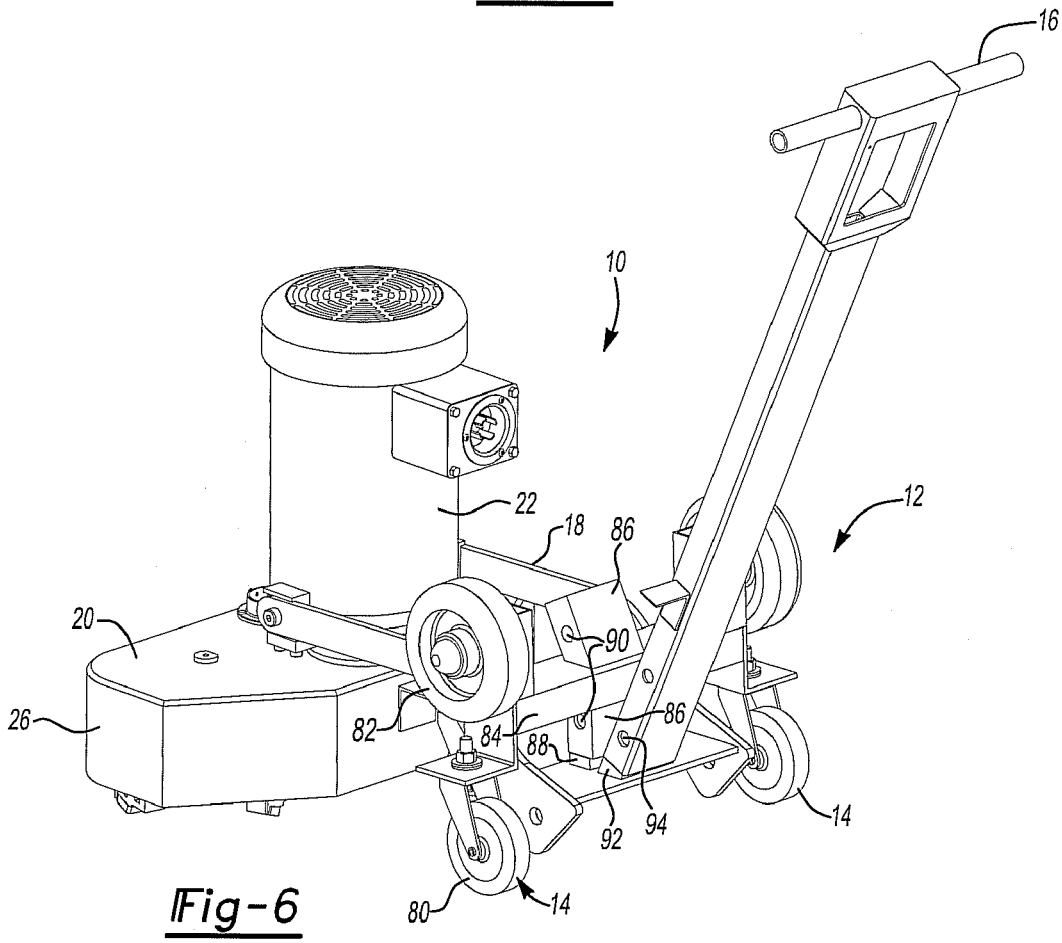
FIG. 6 is rear perspective view and partially fragmentary view illustrating the pivotable connection of the frame assembly to the front housing and motor.
Figure 7:
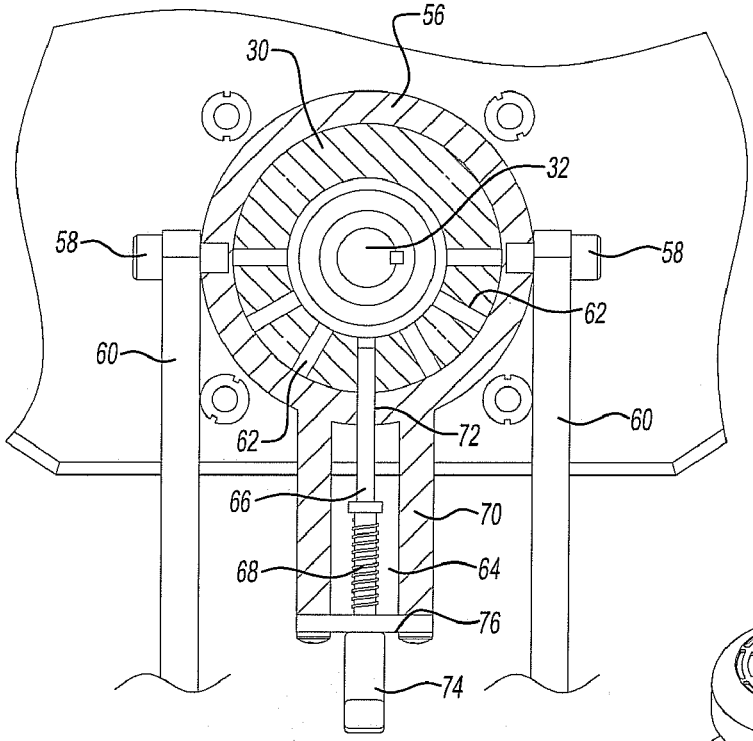
FIG. 7 is an enlarged segmented view of the locking pin engaging the mounting ling on the housing.
Figure 8:
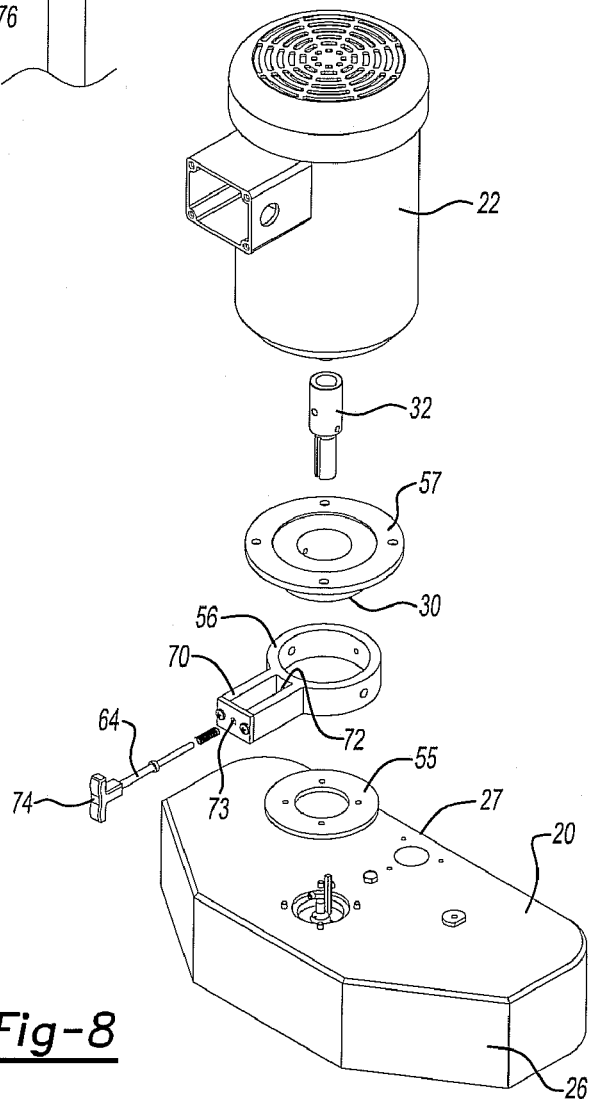
FIG. 8 is an exploded view sharing the locking pin and nested collars for mounting the motor to the deck.

Referring now to FIGS. 3, 6, 7 and 8, the deck 20 is attached to the frame 12 through the inner ring 30 nested within an outer long 56. The inner ring 30 has a lower flange 55 secured to the deck 20 and an upper flange 57 secured to the motor 22. The outer ring 56 is interposed between two prongs 60 of the truck frame and secured thereto via two fasteners 58. As best seen in FIGS. 7 and 8, the inner ring is rotatable with respect to the outer ring. The inner ring also has a plurality of circumferentially spaced apertures 62 therethrough. The outer ring 56 has a spring loaded lock pin assembly 64 that has a horizontally disposed lock pin 66, a coil spring 68 and a bracket 70. The outer ring 56 has a single rear facing aperture 72 aligned with aperture 73 on bracket 70 which secures and orients the pin 66. The pin 66 has a stop handle 74 with a shoulder stop 76 that abuts bracket 70. When the pin 66 is pulled horizontally back against the bias of the spring 68, it disengages from an aperture 62 and the inner ring and deck may rotate to a desired position. The lock pin is then biased back to a forward position to engage one of the apertures 62 to affixedly lock the inner ring and deck with respect to the outer ring and frame. The stop shoulder 76 limits the amount of bias movement of the pin. In this manner, the deck can be angled during operation at a desired position for the operator of the device.

As best shown is FIG. 6, the wheels 14 include a first set of castors 80 and a second set of larger fixed wheels 82 mounted on a reversible sub-assembly 84. The sub-assembly can be reversed through a choice of square tubes 86 mounted on square post 88 on frame 12. The castors 80 are for use during operation of the floor edger. The wheels 82 are only for transport of the floor edger. The selected square tube 86 is locked in place through a lock pin (not shown) extending through apertures 90. The handle 16 is also locked in place on frame 12 on a square post 92 through the use of a lock pin (not shown) extending through aperture 94. The handle can be moved to fit into upper square tube 86 for storage purposes.

In this manner, a durable floor edger and grinder provides ease of operability, ease of movement, durability and protection against undesired marring of vertical walls in a compact package. The ring assembly provides a compact way to both mount the motor and pivotably connect the deck to the frame.

Variations and modifications are possible without departing from the scope and spirit of the present invention as defined by the appended claims.

We claim:

1. A floor edger and grinder device for treating a floor surface comprising:

a frame assembly with floor engaging wheels;

a rear handle operably connected to the frame;

a deck with at least one grinder disc and a motor operably mounted thereto;

said deck having a pivotable connection about a vertical axis to a selective fixed position relative to a front section of said frame assembly;

said pivotable connection having an inner ring fixedly connected to one of said frame assembly and said deck and an outer ring fixedly connected to the other of said frame assembly and said deck;

said inner and outer rings being pivotably engaged to each other;

a securing pin being horizontally disposed and mounted on one of said deck and said frame and being selectively engagable to one of said rings mounted on the other said deck and frame through one of a plurality of apertures therethrough; and said securing pin being horizontally movable to disengage from the inner ring to allow said deck to rotate with respect to said frame.

2. A floor edger and grinder device as defined in claim 1 further comprising:

one of said inner and outer rings mounting the motor thereon; and said motor operably connected to said at least one grinder disc mounted on the underside of said deck.

3. A floor edger and grinder device as defined in claim 2 further comprising:

said at least one grinder disc being first and second grinder discs;

said motor operably connected to a first drive pulley;

a first belt connecting said first drive pulley to a first pulley wheel for rotating said first grinder disc in a first direction;

said first drive pulley operable engaged to a second drive pulley; and a second belt connecting said second drive pulley to a second pulley wheel to rotate said second grinder disc in an opposite direction from the first direction of rotation of said first grinder disc.

4. A floor edger and grinder device as defined in claim 3 further comprising:

said first and second drive pulleys operably engaged to each other through a set of engaging gear wheels; and said gear wheels being mounted such that their axes of rotation coincide with the axes rotation of said respective drive pulleys.

5. A floor edger and grinder device as defined in claim 3 further comprising:

said first and second grinder discs positioned in a side by side lateral relationship relative to a front edge of said deck;

said front edge of said deck having a downwardly depending front skirt, said front skirt having a notch extending across a major portion thereof; and said first and second grinder discs protruding partially into said notch.

6. A floor edger and grinder device as defined in claim 5 further comprising:

a vacuum port passing through a front section of said deck laterally between said first and second grinder discs.

7. A floor edger and grinder device for treating a floor surface comprising:

a deck;

a motor mounted to said deck and having a downwardly extending drive shaft;

first and second pulleys laterally spaced from each other and rotatably connected to said deck with an axis of rotation of each pulley being parallel to an axis of rotation of said drive shaft;

each pulley constructed to have grinder discs mountable thereon;

a first drive pulley directly mounted on said drive shaft such that the rotational axis of the first drive pulley coincides with the rotational axis of the drive shaft;

a first belt engaging said first drive pulley and first pulley for rotating said first pulley in a first rotational direction;

a second drive pulley being rotatably mounted to said housing with its axis of rotation parallel to said rotational axis of said drive shaft;

said first drive pulley engagable to drivingly rotate said second drive pulley; and a second belt engaging said second drive pulley and said second pulley for drivingly rotating said second pulley in a second rotatable direction opposite of said first rotational direction.

8. A floor edger and grinder device as defined in claim 7 further comprising:

said first and second drive pulleys operably engaged to each other through a set of engaging gear wheels; and said gear wheels being mounted such that their axes of rotation coincide with the axes rotation of said respective drive pulleys.

9. A floor edger and grinder device as defined in claim 8 further comprising:

said motor secured to a ring mounted on said deck;

said ring being adjustably affixed about a pivot axis aligned with the rotational axis of said drive shaft to a frame assembly.

10. A floor edger and grinder device as defined in claim 9 further comprising:

said ring having a plurality of a circumferentially spaced apertures engagable to a lock pin on said frame for affixing said ring and said deck in a selected rotated position relative to said frame.

11. A floor edger and grinder device for treating a floor surface comprising:

a deck;

a motor mounted atop of said deck with a drive shaft extending down underneath said deck;

two grinder discs rotatably mounted to an underside of said deck and being laterally positioned relative to each other and operably connected to said drive shaft;

said deck having a downwardly depending skirt guard;

said deck having a straight front section and notch in said front section of said skirt;

said notch having a width extending laterally beyond a point directly in front of each rotational axis of said respective grinder discs;

said grinder discs having a section protruding into said notch;

each of said grinder discs operably mounted to said drive shaft for rotation in opposite directions with respect to each other grinder disc; and said motor and housing being pivotably mounted to a frame assembly with floor engaging wheels and a rear handle.

12. A floor edger as defined in claim 11 further comprising:

said floor engaging wheels include a set of castors mounted on a sub-assembly and engaging the floor when the sub-assembly is mounted to the frame assembly in a first position; and said floor engaging wheels include a set of fixed wheels mounted on the sub-assembly and engaging the floor when the sub-assembly is mounted to the frame assembly in a reversed upside down second position.

13. A floor edge as defined in claim 12 further comprising:

said rear handle selectively mounted to the frame assembly in one of an operating position and storage position.

14. A floor edge as defined in claim 11 further comprising:

said rear handle selectively mounted to the frame assembly in one of an operating position and storage position.

* * * * *